United States Patent [19]

Childress

[11] 3,936,294

[45] Feb. 3, 1976

[54] REAGENT FOR ZINC ORE AND METHOD OF UTILIZING SAME

[76] Inventor: Kenneth A. Childress, Box 350, Webb City, Mo. 68490

[22] Filed: Aug. 28, 1974

[21] Appl. No.: 501,221

[52] U.S. Cl. ..... 75/2; 209/166

[51] Int. Cl.[2] ..... C22B 1/00; B03D 1/14

[58] Field of Search ..... 75/2, 117, 1; 423/26, 109; 209/166

[56] References Cited

UNITED STATES PATENTS 2,007,176 4/1933 Brinker ..... 75/2

*Primary Examiner*—Peter D. Rosenberg

*Attorney, Agent, or Firm*—Lowe, Kokjer, Kircher, Wharton & Bowman

[57] ABSTRACT

A method of activating zinc sphalerite mineral is provided. Zinc sphalerite is crushed and ground in a known manner then cleaned and sent to an activating station. An ammoniated aqueous solution of $CuCO_3$ or $CuCl_2$ is used to activate the zinc sphalerite. This activator is a substitute for the heretofore universally used $CuSO_4$ but is less expensive and superior in many ways. After activation a flotation agent is added and air bubbles are introduced into the aqueous media to cause the zinc to float to the surface.

6 Claims, 1 Drawing Figure

REAGENT FOR ZINC ORE AND METHOD OF UTILIZING SAME

Figure 1:
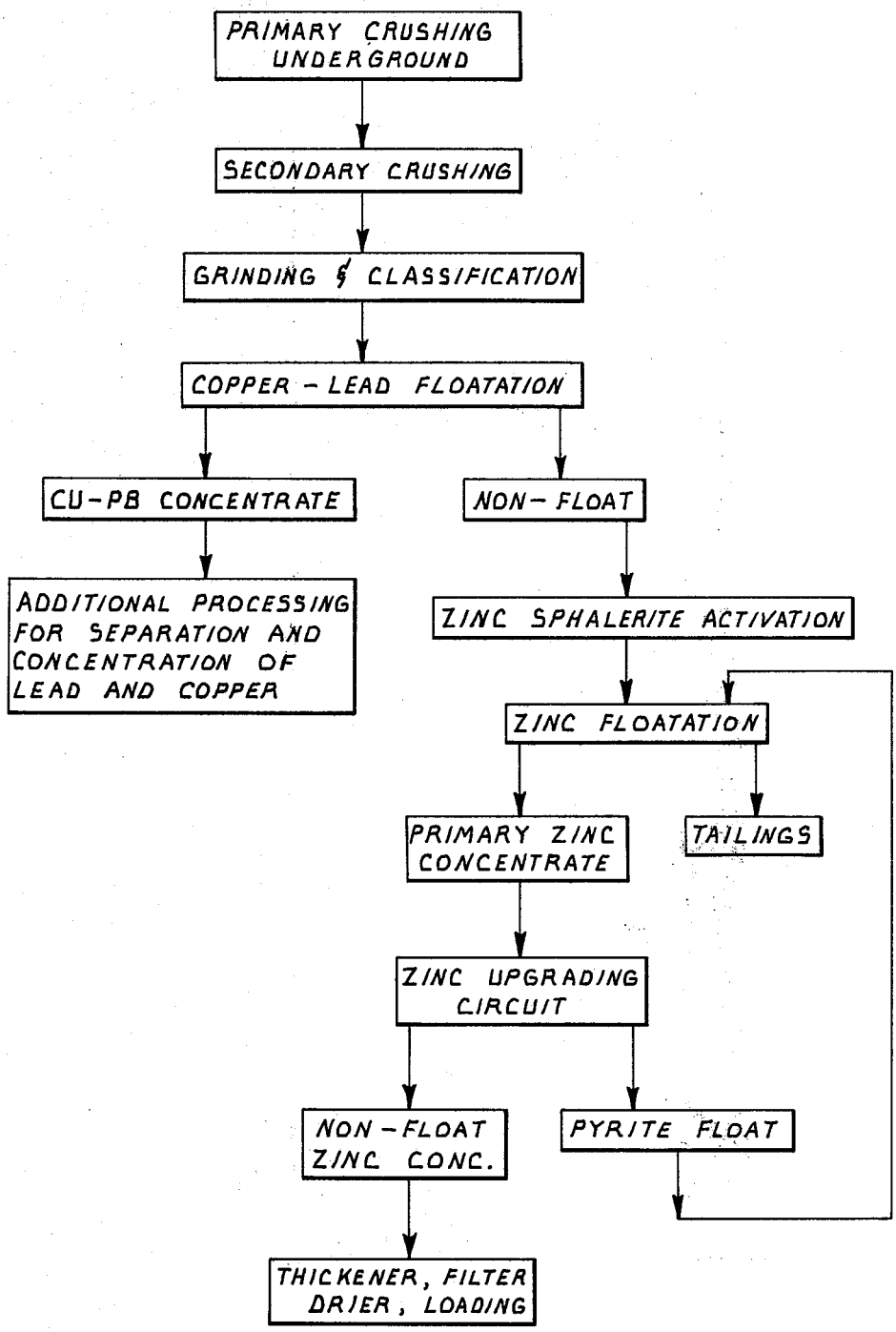

This invention relates generally to zinc mining and, more particularly, to a method of floatation of zinc sphalerite mineral.

For many years the mining of zinc was limited to zinc oxides in various forms. Although it was known that ZnS in the form of sphalerite mineral was an abundant source of the metal, the ability to economically extract the mineral did not exist. The difficulty in mining zinc sphalerite is attributable to its unusual behavior in water. Most ground metallic ores are readily wetted and water affinic. However, when a flotation agent, such as a xanthate is introduced into the aqueous media and air bubbles are formed in the media, the attraction forces between the flotation agent and the ground metal are normally exceeding those of the water-ore and the latter attaches itself to the flotation agent which, because it is water repellant, is carried to the surface with the induced air bubbles. Zinc sphalerite is an exception. There is no affinity between zinc sphalerite and presently known flotation agents.

It was discovered a number of years ago, however, that zinc sphalerite could be "activated" with a very small quantity of $CuSO_4$ so as to render it attracted to known flotation agents. As world supplies of non-sulfide zinc ores have become virtually exhausted, the mining of zinc has become totally dependent upon the activation of zinc sphalerite to permit its separation and concentration by known techniques. The only known reagent for activating zinc sphalerite, heretofore, has been $CuSO_4$.

The cost of $CuSO_4$ has increased even more rapidly than other overhead items in zinc mining and, accordingly, the cost increase has been more rapid than the price increases which have been implemented for zinc at the mine. While others have attempted to find a substitute activator for zinc sphalerite, to use in place of $CuSO_4$, the search has not met with success.

It is, therefore, a primary object of the present invention to provide a method of zinc flotation utilizing an activator for zinc sphalerite other than $CuSO_4$.

As a corollary to the above object, it is an aim of this invention to provide a method of activating zinc sphalerite for flotation utilizing an activator which is present in a basic, rather than acid, media thereby reducing the quantity of base required to adjust the pH of the floatation media to the desired level.

It is also an objective of my invention to provide a method of activating zinc sphalerite for flotation utilizing an activator having greater solubility in water than $CuSO_4$ thereby allowing lesser quantities of a higher strength activating solution to be utilized for $CuSO_4$ solutions.

Still another object of this invention is to provide a method of activating zinc sphalerite for flotation as described in the foregoing objects wherein the activator is compatible with known flotation agents.

It is also an aim of the invention to provide a method of activating zinc sphalerite utilizing an activator other than $CuSO_4$ and which is affective even in relatively impure solutions thereby minimizing the cost of the activator.

Other objects of the invention will be made clear or become apparent when the following description and claims are read in light of the accompanying drawing wherein:

The single FIGURE is a flow diagram showing a typical zinc mining operation utilizing the method of the present invention.

With reference to the drawing, it is seen that the first stage in the processing of zinc ore after its removal from the mineral deposit is an initial crushing. This normally takes place underground and the ore is reduced in size to approximately 5 inches diameter or less by a jaw crusher. The crushed ore is brought to the surface where it undergoes further crushing to reduce the size to less than 1 inch, preferably less than ½ inch.

A number of variations in the grinding step are possible depending upon the quality and content of the ore, the capacity of the mill, and the extent to which modern technology and equipment may be implemented in the mill. Either single or multiple stage grinding may be used, the latter being preferred although the former being adequate in some instances. Both ball and rod mills of a type well known to those skilled in the art are used to accomplish the grinding step with dilution water being added in optimum proportions.

Classification of the ground product takes place on a sequential basis with oversize material being returned for reprocessing and the remaining material being forwarded to the next station. Examples of two types of classifier which may be employed are rake classifiers and cyclone classifiers. Differential grinding may also be employed wherein a flotation step is interposed between first and second grinding steps. In differential grinding the overflow of the primary classifier passes to the rougher lead or copper circuit. A portion of the rougher concentrate is then removed by flotation and the tailing is passed to the secondary grinding circuit. Many other variations in the grinding and classification steps will be readily apparent to those skilled in the art.

In the large majority of zinc deposits the zinc mineral is contaminated with other elements, most frequently lead, copper and cadmium. These metals are themselves valuable enough to economically justify recovery. Separation of zinc from other metals in its preserve can be effectively and economically accomplished utilizing differential flotation techniques. A detailed discussion of the differential flotation of zinc, copper and lead is not required for a complete and full understanding of the present invention although these steps are represented in the accompanying drawing. A detailed discussion of differential flotation techniques along with other aspects of zinc mining is contained in *AIME World Symposium on Mining and Metallurgy of LEAD and ZINC*; Vol. 1, Rausch and Mariacher, eds., The American Institute of Mining, Metallurgical and Petroleum Engineers, Inc. (1970).

After flotation of the copper-lead fraction of the mineral ore, the non-floating fraction containing the zinc sphalerite is advanced to an activation station. At this point a preferably saturated solution of either ammoniated aqueous $CuCl_2$ or ammoniated aqueous $CuCO_3$ is added to the aqueous media containing zinc sphalerite. The specific quantity of the activating solution utilized will vary considerably depending upon a number of factors. In general, a sufficient quantity of either ammoniated $CuCl_2$ or ammoniated $CuCO_3$ should be added to assure complete flotation of ZnS and, while some excess of the activating solution can be tolerated, economic conditions dictate that excesses be avoided. The quantity of solution utilized to activate will, of course, vary with the strength of the solution. The content of ZnS in the ore is another inherent variable in determining the quantity of activating solution to be utilized. Still another factor to be considered in activating the ZnS for flotation is the quantity of soluble Cu or CuO present in the mineral ore. The presence of this contaminate naturally reduces the quantity of activating solution required. In the absence of copper contamination and employing a saturated solution of either ammoniated $CuCl_2$ or ammoniated $CuCO_3$, the following formula may be used to determine the quantity of activating solution utilized:

$$X = \text{(from about)}\ \frac{y}{.2}\ \text{to (about)}\ \frac{y}{.08}$$

where

X = pounds of saturated solution of ammoniated $CuCl_2$ or ammoniated $CuCO_3$ per ton of mineral ore; and $y$ = weight per cent of zinc in the mineral ore It is to be understood that the above range for the quantity of activating solution is not intended to be limiting; variations determined empirically in accordance with specific conditions are contemplated.

After activation of the zinc sphalerite, preferably immediately prior to floatation, a suitable flotation agent is added to the aqueous media. Typical flotation agents which may be utilized include sodium ethyl xanthate, amyl xanthate, methyl isobutyl carbinol, compounds sold under the trademark "Aerofloat" by American Cyanamid Co. and those sold under the trademark "Minerec" by Minerec Corporation. Lime is added during the floating step to control the pH of the aqueous media above 9.0 and preferably about 9.2. Temperature is also controlled according to known techniques with the pH being varied in accordance with the operating temperature. These parameters of pH and temperature control are well known within the knowledge of those skilled in the art and the present invention is not concerned with these known practices which will not be discussed in detail in the interest of brevity.

The primary zinc concentrate from the flotation step is passed to the zinc upgrading circuit where the pH is lowered and the concentrate heated. At this stage additional flotation agent is added to separate pyrite from the primary zinc concentrate to upgrade the ore. The pyrite is returned to the primary zinc flotation circuit for additional reclamation. The zinc concentrate is advanced for dewatering by thickening, filtering and drying, by the use of conventional equipment. Likewise, tailings are disposed of according to techniques well known to those skilled in the art.

It is to be understood that the foregoing description is intended as only one example of applying the method of the present invention to the recovery of zinc sphalerte ore. Many variations in the specific mill procedure will be apparent to those skilled in the art. It is contemplated that the present invention will find use and advantage whenever it is desired to separate zinc sphalerte using flotation techniques.

Among the advantages afforded by the present invenion is the fact that the ammoniated $CuCl_2$ and $CuCO_3$ olutions are readily attainable at a fraction of the cost of the heretofore universally employed $CuSO_4$. One source for the solution utilized in the present invention is spent etching solution utilized in the printed circuit board industry. Another advantage of the invention is the increased solubility of $CuCl_2$ and $CuCO_3$ in ammoniated aqueous solution in comparison with $CuSO_4$. This offers advantages in shipping and handling as well as further increased economy. Still another major advantage of the present invention is the basic nature of the ammoniated $CuCl_2$ and $CuCO_3$ as opposed to the acidic nature of $CuSO_4$. This reduces the requirements for the addition of lime during the flotation step and also enhances efficiency of flotation.

Having thus described the invention, I claim:

1. A method of activating zinc sphalerite mineral for flotation in an aqueous media comprising adding to said media a quantity of a solution selected from the group consisting of an ammoniated aqueous solution of $CuCl_2$, an ammoniated aqueous solution of $CuCO_3$, and an ammoniated aqueous solution comprising $CuCl_2$ and $CuCO_3$.

2. A method as set forth in claim 1, wherein said addition step comprises adding a quantity of said solution according to the formula:

$$X = \text{(from about)}\ \frac{y}{.2}\ \text{to (about)}\ \frac{y}{.08}$$

where

X = pounds of saturated solution per ton mineral ore; and y = weight per cent zinc in the mineral ore.

3. A method as set forth in claim 1, wherein said addition step comprises adding said solution immediately prior to the addition of a flotation agent.

4. A method as set forth in claim 3, wherein said addition step comprises adding said solution subsequent to cleaning of said mineral.

5. A method of flotation of zinc sphalerite mineral ore comprising the steps of:

guiding the zinc sphalerite ore in an aqueous media;

separating the zinc sphalerite from contaminate metal ores;

adding to said media a quantity of a solution selected from the group consisting of an ammoniated aqueous solution of $CuCl_2$, an ammoniated aqueous solution of $CuCO_3$, and an ammoniated aqueous solution comprising $CuCl_2$ and $CuCO_3$;

adding a flotation agent to said media; and introducing air into said media to cause the formation of air bubbles whereby to float said zinc sphalerite to the surface of the media.

6. A method as set forth in claim 5 wherein the step of adding a solution to the media comprises adding a quantity according to the formula:

$$X = \text{(from about)}\ \frac{y}{.2}\ \text{to (about)}\ \frac{y}{.08}$$

where

X = pounds of saturated solution per ton mineral ore; and y = weight per cent zinc in the mineral ore.

* * * * *

UNITED STATES PATENT OFFICE

CERTIFICATE OF CORRECTION

Patent No. 3,936,294 Dated February 3, 1976

Inventor(s) CHILDRESS, KENNETH A.

It is certified that error appears in the above-identified patent and that said Letters Patent are hereby corrected as shown below:

col. 4 (Claim 5), line 3, delete "guiding" and substitute -- grinding --.

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*